US010233522B2

(12) United States Patent
Stewart

(10) Patent No.: US 10,233,522 B2
(45) Date of Patent: Mar. 19, 2019

(54) LOW COBALT HARD FACING ALLOY

(71) Applicant: ROLLS-ROYCE plc, London (GB)

(72) Inventor: David A Stewart, Derby (GB)

(73) Assignee: ROLLS-ROYCE plc, London (GB)

( * ) Notice: Subject to any disclaimer, the term of this patent is extended or adjusted under 35 U.S.C. 154(b) by 114 days.

(21) Appl. No.: 15/400,847

(22) Filed: Jan. 6, 2017

(65) Prior Publication Data

US 2017/0218491 A1 Aug. 3, 2017

(30) Foreign Application Priority Data

Feb. 1, 2016 (GB) ..... 1601764.2

(51) Int. Cl.

| | |
|---|---|
| ***C22C 38/00*** | (2006.01) |
| ***C22C 38/04*** | (2006.01) |
| ***C22C 38/34*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/56*** | (2006.01) |

(52) U.S. Cl.

CPC ..... *C22C 38/56* (2013.01); *C22C 38/001* (2013.01); *C22C 38/002* (2013.01); *C22C 38/04* (2013.01); *C22C 38/34* (2013.01); *C22C 38/44* (2013.01); *C22C 38/46* (2013.01); *C22C 38/48* (2013.01); *C22C 38/50* (2013.01); *C22C 38/52* (2013.01)

(58) Field of Classification Search

CPC ..... C22C 38/001; C22C 38/002; C22C 38/04; C22C 38/34; C22C 38/44; C22C 38/46; C22C 38/48; C22C 38/50; C22C 38/52; C22C 38/56

See application file for complete search history.

(56) References Cited

U.S. PATENT DOCUMENTS 2,416,515 A 2/1947 Evans, Jr.
4,077,801 A * 3/1978 Heyer ..... C22C 19/055 148/427
4,141,762 A 2/1979 Yamaguchi et al.
4,812,177 A * 3/1989 Maehara ..... C21D 8/005 148/505
4,854,185 A * 8/1989 Lichtenberg ..... F16C 1/226 188/196 B
4,981,647 A * 1/1991 Rothman ..... C22C 30/00 420/43
5,077,006 A 12/1991 Culling
5,310,431 A * 5/1994 Buck ..... C22C 38/52 148/325
5,512,237 A * 4/1996 Stigenberg ..... C22C 38/42 420/38
5,514,328 A * 5/1996 Menon ..... C22C 38/52 420/36
5,660,939 A 8/1997 Burdett
5,695,716 A * 12/1997 Kohler ..... C22C 30/00 148/442
5,820,817 A * 10/1998 Angeliu ..... C22C 38/002 420/40
5,944,922 A * 8/1999 Kadoya ..... C21D 6/004 148/325
RE36,382 E * 11/1999 Hultin-Stigenberg ..... C22C 38/42 420/38
6,165,627 A * 12/2000 Miyazaki ..... C22C 38/105 148/320
6,174,385 B1 * 1/2001 Morinaga ..... C22C 38/00 148/325
6,426,038 B1 * 7/2002 Fedchun ..... C22C 38/002 420/104
6,426,040 B1 * 7/2002 Fedchun ..... C22C 38/002 420/104
6,464,804 B2 * 10/2002 Goecmen ..... C21D 6/004 148/325
6,479,013 B1 * 11/2002 Sera ..... B22D 17/2023 148/325
6,485,679 B1 * 11/2002 Sundstrom ..... C22C 38/44 420/38
6,630,103 B2 * 10/2003 Martin ..... C21D 6/02 148/325

(Continued)

FOREIGN PATENT DOCUMENTS

| | | |
|---|---|---|
| EP | 0 735 155 A1 | 10/1996 |
| GB | 2 167 088 A | 5/1986 |
| JP | H06-170584 A | 6/1994 |

OTHER PUBLICATIONS

Aug. 9, 2017 Search Report issued in European Patent Application No. 17 15 0537.

Oct. 5, 2016 Search Report issued in British Patent Application No. 1601764.2.

*Primary Examiner* — Cam N. Nguyen

(74) *Attorney, Agent, or Firm* — Oliff PLC

(57) ABSTRACT

A stainless steel alloy comprising essentially of 19 to 22 percent by weight chromium, 8.5 to 10.5 percent by weight nickel, 5.25 to 5.75 percent by weight silicon, 0.25 to 2.0 percent by weight carbon, 4.0 to 10.5 percent by weight molybdenum, 0.3 to 0.5 percent by weight titanium, 0.1 to 0.5 by weight percent nitrogen and the balance iron plus impurities. The impurities may consist of 0 to 0.2 percent by weight cobalt, 0 to 0.5 percent by weight manganese, 0 to 0.3 percent by weight molybdenum, 0 to 0.03 percent by weight phosphor, 0 to 0.03 percent by weight sulphur, 0 to 0.1 percent by weight nitrogen.

20 Claims, No Drawings

(56) References Cited

U.S. PATENT DOCUMENTS 6,667,005 B2 * 12/2003 Ishida ..... C22C 38/42 148/333
6,685,881 B2 * 2/2004 Hamano ..... C22C 38/001 420/41
6,702,905 B1 * 3/2004 Qiao ..... C21D 6/002 148/326
6,764,645 B2 * 7/2004 Hayaishi ..... C22C 38/001 148/622
6,769,414 B2 * 8/2004 Rembold ..... F02D 33/006 123/179.17
6,773,519 B2 * 8/2004 Fujita ..... C21D 9/38 148/335
6,773,661 B2 * 8/2004 Hayaishi ..... C22C 38/14 420/84
6,793,745 B2 * 9/2004 Weber ..... C21D 6/004 148/325
6,818,072 B2 * 11/2004 Kondo ..... C21D 8/10 148/320
6,866,816 B2 * 3/2005 Liang ..... C22C 33/0285 148/324
6,890,393 B2 * 5/2005 Buck ..... C21D 6/004 148/325
6,896,747 B2 * 5/2005 Hauser ..... C21D 8/065 148/327
6,899,773 B2 * 5/2005 Buck ..... C21D 6/004 148/325
7,153,373 B2 * 12/2006 Maziasz ..... C21D 6/005 148/327
7,160,399 B2 * 1/2007 Kuehmann ..... C21D 6/02 148/326
7,235,212 B2 * 6/2007 Kuehmann ..... C21D 6/02 420/107
7,255,755 B2 * 8/2007 Maziasz ..... C21D 6/005 148/327
7,258,752 B2 * 8/2007 Maziasz ..... C22C 38/001 148/326
7,297,214 B2 * 11/2007 Ishida ..... C22C 19/055 148/310
7,326,307 B2 * 2/2008 Ueta ..... C22C 38/02 148/327
7,425,240 B2 * 9/2008 Guelton ..... C21D 8/0415 148/541
7,611,590 B2 * 11/2009 Liang ..... B22F 5/008 148/324
7,651,575 B2 * 1/2010 Sawford ..... C22C 19/058 148/410
7,658,883 B2 * 2/2010 Marya ..... C22C 38/001 148/327
7,686,898 B2 * 3/2010 Nazmy ..... C22C 38/001 148/325
7,700,037 B2 * 4/2010 Westin ..... C22C 38/001 420/128
7,708,841 B2 * 5/2010 Saller ..... C22C 38/58 148/327
7,718,014 B2 * 5/2010 Usami ..... B23K 35/3053 148/332
7,731,896 B2 * 6/2010 Usami ..... B23K 35/3053 420/119
7,744,813 B2 * 6/2010 Brady ..... C22C 38/02 148/326
RE41,504 E * 8/2010 Maziasz ..... C21D 6/005 148/327
7,922,968 B2 * 4/2011 Son ..... C22C 38/02 148/320
8,012,269 B2 * 9/2011 Yamamoto ..... C22C 38/002 148/101
8,025,839 B2 * 9/2011 Jonson ..... C22C 38/24 148/325
8,192,682 B2 * 6/2012 Maziasz ..... E21B 36/04 148/326
8,313,589 B2 * 11/2012 Takasawa ..... C21D 1/28 148/330
8,317,944 B1 * 11/2012 Jablonski ..... C23C 12/02 148/325
8,317,946 B2 * 11/2012 Arai ..... C21D 8/10 148/335
8,318,083 B2 * 11/2012 Pankiw ..... C22C 30/00 148/327
8,337,748 B2 * 12/2012 Rakowski ..... C22C 38/38 148/325
8,337,749 B2 * 12/2012 Bergstrom ..... C22C 38/42 420/56
8,414,715 B2 * 4/2013 Altschuler ..... C21D 1/25 148/590
8,430,075 B2 * 4/2013 Qiao ..... C22C 38/02 123/188.3
8,431,072 B2 * 4/2013 Muralidharan ..... B22D 25/06 420/43
8,444,776 B1 * 5/2013 Bailey ..... C21D 6/001 148/335
8,454,765 B2 * 6/2013 Saller ..... C22C 38/58 148/327
8,460,800 B2 * 6/2013 Hoshika ..... C22C 38/001 428/213
8,479,700 B2 * 7/2013 Qiao ..... C22C 1/02 123/188.3
8,540,933 B2 * 9/2013 Nylof ..... C22C 38/001 148/325
8,562,761 B2 * 10/2013 Gunnarsson ..... C21D 1/25 148/328
8,580,050 B2 * 11/2013 Morita ..... C22C 38/001 148/316
8,580,190 B2 * 11/2013 Hattendorf ..... C22C 38/001 148/325
8,623,108 B2 * 1/2014 Theisen ..... B22F 9/082 420/127
8,784,278 B2 * 7/2014 Flake ..... A63B 22/0264 482/54
9,051,634 B2 * 6/2015 Morohoshi ..... C21D 9/46
9,121,088 B2 * 9/2015 Bailey ..... C21D 1/56
9,121,089 B2 * 9/2015 Bergstrom ..... C22C 38/42
9,133,538 B2 * 9/2015 Rakowski ..... C22C 38/38
9,157,131 B2 * 10/2015 Zou ..... C21D 1/667
9,181,597 B1 * 11/2015 Hawk ..... C21D 6/002
9,200,343 B2 * 12/2015 Matsuda ..... C21D 9/46
9,228,250 B2 * 1/2016 Alves ..... B23K 35/0261
9,284,631 B2 * 3/2016 Radon ..... C22C 37/10
9,334,547 B2 * 5/2016 Qiao ..... C21D 9/0068
9,347,121 B2 * 5/2016 Forbes Jones ..... C22C 38/42
9,458,743 B2 * 10/2016 Qiao ..... C21D 5/00
9,499,890 B1 * 11/2016 Zhang ..... C22C 38/50
9,513,071 B2 * 12/2016 Sjodin ..... B23K 35/308
9,513,072 B2 * 12/2016 Sjodin ..... B23K 35/308
9,555,158 B2 * 1/2017 Meyer-Kobbe ..... C21D 6/002
9,556,503 B1 * 1/2017 Hawk ..... C22C 38/54
9,593,916 B2 * 3/2017 Bailey ..... C21D 6/001
9,657,382 B2 * 5/2017 Funakawa ..... C22C 38/001
9,689,050 B2 * 6/2017 Bouaziz ..... C21D 6/02
9,689,061 B2 * 6/2017 Angles ..... C22C 38/12
9,702,641 B2 * 7/2017 Sjodin ..... B23K 35/308
9,797,033 B2 * 10/2017 Li ..... C22C 38/38
9,803,267 B2 * 10/2017 Roscoe ..... C22C 38/34
9,816,165 B2 * 11/2017 Li ..... C22C 38/32
9,822,435 B2 * 11/2017 Bergstrom ..... C22C 38/42
9,845,518 B2 * 12/2017 Cobo ..... C21D 9/0068
9,869,009 B2 * 1/2018 Vartanov ..... C21D 9/30
9,873,932 B2 * 1/2018 Bergstrom ..... C22C 38/58
9,903,023 B2 * 2/2018 Maruyama ..... C23C 30/005
9,919,385 B2 * 3/2018 Sjodin ..... B23K 35/308
9,932,867 B2 * 4/2018 Qiao ..... F01L 3/02
9,963,766 B2 * 5/2018 Sachadel-Solarek ..... C22C 38/54
9,981,346 B2 * 5/2018 Han ..... B23K 35/0266

* cited by examiner

LOW COBALT HARD FACING ALLOY

FIELD OF THE INVENTION

The present invention relates to steel alloys and particularly a chromium nickel silicon stainless steel alloy with low cobalt that may be suited for use in nuclear reactors, particularly in the components used in the steam generating plant of nuclear reactors.

BACKGROUND OF THE INVENTION

Traditionally, cobalt-based alloys, including Stellite alloys, have been used for wear-based applications including, for example, in nuclear power applications. The alloys may be used to both form components or to provide hard-facing where harder or tougher material is applied to a base metal or substrate.

It is common for hard-facing to be applied to a new part during production to increase its wear resistance. Alternatively, hard-facing may be used to restore a worn surface. Extensive work in research has resulted in the development of a wide range of alloys and manufacturing procedures dependent on the properties and/or characteristics of the required alloy.

Within the nuclear industry the presence of cobalt within an alloy gives rise to the potential for the cobalt to activate within a neutron flux to result in the radioisotope cobalt-60 which has a long half-life. This makes the use of cobalt undesirable for alloys used in this industry. The cobalt may be released as the alloy wears through various processes, one of which is galling that is caused by adhesion between sliding surfaces caused by a combination of friction and adhesion between the surfaces, followed by slipping and tearing of crystal structure beneath the surface. This will generally leave some material stuck or even friction welded to the adjacent surface, whereas the galled material may appear gouged with balled-up or torn lumps of material stuck to its surface.

Replacements for Stellite have been developed by the industry with low or nil cobalt quantities. Exemplary alloys are detailed in the table below:

| | Alloy | | | | | | | | |
|---|---|---|---|---|---|---|---|---|---|
| | Cr | C | Nb | Nb + Va | Ni | Si | Fe | Co | Ti |
| GB2167088 | 15-25 | 1-3 | | 5-15 | 5-15 | 2.7-5.6 | Bal | Nil | Nil |
| T5183 | 19-22 | 1.8-2.2 | 6.5-8.0 | | 8.5-10.5 | 4.5-5.25 | Bal | 0.2 | Trace |
| U.S. Pat. No. 5,660,939 | 19-22 | 1.7-2.0 | 8.0-9.0 | | 8.5-10.5 | 5.25-5.75 | Bal | 0.2 | 0.3-0.7 |

In GB2167088 niobium is provided, but always with the presence of vanadium, which prevents the chromium from combining with the carbon and weakening the matrix. The vanadium also acts as a grain refiner within the wholly austenitic alloy that helps the keep the size of the grains within the alloy within an acceptable range.

The alloys of U.S. Pat. No. 5,660,939 modified the alloy of T5183 by the deliberate addition of titanium and by increasing the amounts of niobium and silicon. The controlled additions of titanium, niobium and silicon alter the structure of the steel to provide a duplex austenitic/ferritic microstructure which undergoes secondary hardening due to the formation of an iron silicon intermetallic phase.

Further hardening is achievable by hot isostatic pressing (HIPPING) of the stainless steel alloy when in powder form where secondary hardening occurs within the ferritic phase of the duplex microstructure.

The niobium provides a preferential carbide former over chromium, enabling high chromium levels to be maintained within the matrix so as to give good corrosion performance. Low cobalt based alloys, or cobalt alloy replacements, typically comprise significant quantities of carbide forming elements which can form alloys with hardness values in excess of 500 Hv. As with traditional Stellite alloys, the high levels of hardness observed can make machining difficult, resulting in poor mechanical properties for, for example, ductility, fracture toughness, impact resistance and workability. Additionally, the cost of using such alloys is high due to the need for special treatments and/or precision casting or other near net shape manufacturing methods to limit further machining.

Accordingly, it would therefore be advantageous to provide an alloy without the aforementioned disadvantages.

SUMMARY OF THE INVENTION

The present invention accordingly provides, in a first aspect, an alloy consisting essentially of 19 to 22 percent by weight chromium, 8.5 to 10.5 percent by weight nickel, 5.25 to 5.75 percent by weight silicon, 0.25 to 2.0 percent by weight carbon, 4.0 to 10.5 percent by weight of a carbide former selected from the group consisting of molybdenum, tantalum, tungsten, zirconium and vanadium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 to 2/0 percent by weight carbon, 4.0 to 10.5 percent by weight molybdenum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight molybdenum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.8 to 1.2 percent by weight carbon, 4.0 to 6.0 percent by weight molybdenum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 1.7 to 2.0 percent by weight carbon, 8.5 to 10.5 percent by weight molybdenum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight titanium, 0.1 to 0.5 by weight percent nitrogen and the balance iron plus impurities.

The alloy may consist essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight tantalum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight tantalum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight tantalum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight tantalum, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight tungsten, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight tungsten, 0.3 to 0.5 percent by weight titanium, 0.1 to 0.5 by weight percent nitrogen and the balance iron plus impurities.

The alloy may consist essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight tungsten, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight tungsten, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight Zirconium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight Zirconium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight Zirconium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight Zirconium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight vanadium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight vanadium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight vanadium, 0.3 to 0.5 percent by weight titanium, 0.1 to 0.5 by weight percent nitrogen and the balance iron plus impurities.

The alloy may consist essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight vanadium, 0.3 to 0.5 percent by weight titanium, 0.1 to 0.5 by weight percent nitrogen and the balance iron plus impurities.

The impurities in these alloys may consist of 0 to 0.2 percent by weight cobalt, 0 to 0.5 percent by weight manganese, 0 to 0.3 percent by weight molybdenum, 0 to 0.03 percent by weight phosphor, 0 to 0.03 percent by weight sulphur.

The alloy may be in powder form which is consolidated in a hot isostatic press.

The alloy may be applied to an article to provide a coating on the article. The coating may be hard faced or formed on the article by welding.

The alloy may be used in a steam generating plant. The steam may be generated through a nuclear reaction.

Preferred embodiments of the present invention will now be described, by way of example only.

DETAILED DESCRIPTION OF THE PREFERRED EMBODIMENTS

The improved alloys described here have been developed having, in weight percent, 19 to 22 percent by weight chromium, 8.5 to 10.5 percent by weight nickel, 5.25 to 5.75 percent by weight silicon, 0.25 to 2.0 percent by weight carbon, 4.0 to 10.5 percent by weight of a carbide former selected from the group consisting of molybdenum, tantalum, tungsten, zirconium and vanadium, 0.3 to 0.5 percent by weight titanium, 0.1 to 0.5 by weight percent nitrogen and the balance iron plus impurities.

The impurities may be up to 0.2 wt % cobalt, up to 0.5 wt % manganese, up to 0.03 wt % phosphor, up to 0.03 wt % sulphur and up to 0.1 wt % nitrogen. In the alloys which use titanium, tantalum, tungsten, zirconium or vanadium as the carbide former the alloy may contain an impurity of up to 0.3 wt % molybdenum These compositions are similar to those proposed in U.S. Pat. No. 5,660,939 but there is a reduction in the niobium content and substitution with one or more carbide formers selected from the group consisting molybdenum, titanium, tantalum, tungsten, zirconium and vanadium.

Molybdenum is a carbide former which may be provided within the alloy in a quantity which further improves the properties of the alloy as it is provided in such a quantity that residual molybdenum following the formation of the carbides remains within the matrix and provides an improved pitting resistance.

In addition molybdenum carbide and tungsten carbide form at lower temperatures than niobium carbide and have a tendency to form molybdenum, or tungsten containing chromium carbides where the chromium content is in the range 19 to 22 by weight. Where niobium has been used as the carbide former it has been found that because it is a strong carbide former niobium carbides can form whilst atomising (or early on in casting if by that route) and grow which can then lead to nozzle blockages etc and hence low powder yield. Because molybdenum and tungsten have less affinity to form carbides than chromium the reaction with carbon provides molybdenum-containing chromium (Cr, Mo)C carbides rather than molybdenum carbides or tungsten-containing chromium (Cr, W)C carbides. In this way manufacturability of the alloy is maintained.

Exemplary alloy 1 consists essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight titanium, 0.1 to 0.5 by weight percent nitrogen and the balance iron plus impurities.

Exemplary alloy 2 consists essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight titanium, 0.1 to 0.5 by weight percent nitrogen and the balance iron plus impurities.

Exemplary alloy 3 consists essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight titanium, 0.1 to 0.5 by weight percent nitrogen and the balance iron plus impurities.

Exemplary alloy 4 consists essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight titanium, 0.1 to 0.5 by weight percent nitrogen and the balance iron plus impurities.

Exemplary alloy 5 consists essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight tantalum, 0.3 to 0.5 percent by weight titanium, 0.1 to 0.5 by weight percent nitrogen and the balance iron plus impurities.

Exemplary alloy 6 consists essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight tantalum, 0.3 to 0.5 percent by weight titanium, 0.1 to 0.5 by weight percent nitrogen and the balance iron plus impurities.

Exemplary alloy 7 consists essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight tantalum, 0.3 to 0.5 percent by weight titanium, 0.1 to 0.5 by weight percent nitrogen and the balance iron plus impurities.

Exemplary alloy 8 consists essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight tantalum, 0.3 to 0.5 percent by weight titanium, 0.1 to 0.5 by weight percent nitrogen and the balance iron plus impurities.

Exemplary alloy 9 consists essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight tungsten, 0.3 to 0.5 percent by weight titanium, 0.1 to 0.5 by weight percent nitrogen and the balance iron plus impurities.

Exemplary alloy 10 consists essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight tungsten, 0.3 to 0.5 percent by weight titanium, 0.1 to 0.5 by weight percent nitrogen and the balance iron plus impurities.

Exemplary alloy 11 consists essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight tungsten, 0.3 to 0.5 percent by weight titanium, 0.1 to 0.5 by weight percent nitrogen and the balance iron plus impurities.

Exemplary alloy 12 consists essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight tungsten, 0.3 to 0.5 percent by weight titanium, 0.1 to 0.5 by weight percent nitrogen and the balance iron plus impurities.

Exemplary alloy 13 consists essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight Zirconium, 0.3 to 0.5 percent by weight titanium, 0.1 to 0.5 by weight percent nitrogen and the balance iron plus impurities.

Exemplary alloy 14 consists essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight Zirconium, 0.3 to 0.5 percent by weight titanium, 0.1 to 0.5 by weight percent nitrogen and the balance iron plus impurities.

Exemplary alloy 15 consists essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight Zirconium, 0.3 to 0.5 percent by weight titanium, 0.1 to 0.5 by weight percent nitrogen and the balance iron plus impurities.

Exemplary alloy 16 consists essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight Zirconium, 0.3 to 0.5 percent by weight titanium, 0.1 to 0.5 by weight percent nitrogen and the balance iron plus impurities.

Exemplary alloy 17 consists essentially of 19 to 22 percent by weight chromium, 8.5 to 10.5 percent by weight nickel, 5.25 to 5.75 percent by weight silicon, 0.25 to 2.0 percent by weight carbon, 4.0 to 9.0 percent by weight vanadium, 0.3 to 0.5 percent by weight titanium, 0.1 to 0.5 by weight percent nitrogen and the balance iron plus impurities.

Exemplary alloy 18 consists essentially of 19 to 22 percent by weight chromium, 8.5 to 10.5 percent by weight nickel, 5.25 to 6.0 percent by weight silicon, 1.7 to 2.0 percent by weight carbon, 8.0 to 9.0 percent by weight vanadium, 0.3 to 0.5 percent by weight titanium, 0.1 to 0.5 by weight percent nitrogen and the balance iron plus impurities.

Exemplary alloy 19 consists essentially of 19 to 22 percent by weight chromium, 8.5 to 9.5 percent by weight nickel, 5.25 to 5.75 percent by weight silicon, 0.8 to 1.2 percent by weight carbon, 4.0 to 6.0 percent by weight vanadium, 0.3 to 0.5 percent by weight titanium, 0.1 to 0.5 by weight percent nitrogen and the balance iron plus impurities.

Exemplary alloy 20 consists essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight vanadium, 0.3 to 0.5 percent by weight titanium, 0.1 to 0.5 by weight percent nitrogen and the balance iron plus impurities.

Exemplary alloy 21 consists essentially of 19 to 22 percent by weight chromium, 8.5 to 10.5 percent by weight nickel, 5.25 to 5.75 percent by weight silicon, 0.25 percent by weight carbon, 4.0 to 6.0 percent by weight molybdenum, 0.3 to 0.5 percent by weight titanium, 0.1 to 0.5 by weight percent nitrogen and the balance iron plus impurities.

Exemplary alloy 22 consists essentially of 19 to 22 percent by weight chromium, 8.5 to 10.5 percent by weight nickel, 5.25 to 5.75 percent by weight silicon, 0.8 to 1.2 percent by weight carbon, 4.0 to 6.0 percent by weight molybdenum, 0.3 to 0.5 percent by weight titanium, 0.1 to 0.5 by weight percent nitrogen and the balance iron plus impurities.

Exemplary alloy 23 consists essentially of 19 to 22 percent by weight chromium, 8.5 to 10.5 percent by weight nickel, 5.25 to 5.75 percent by weight silicon, 1.7 to 2.0 percent by weight carbon, 8.5 to 10.5 percent by weight molybdenum, 0.3 to 0.5 percent by weight titanium, 0.1 to 0.5 by weight percent nitrogen and the balance iron plus impurities.

In each of the above exemplary alloys impurities, which may be deliberately added, may be present. The impurities may be up to 0.2 wt % cobalt, up to 0.5 wt % manganese, up to 0.03 wt % phosphor, up to 0.03 wt % sulphur and up to 0.1 wt % nitrogen, up to 200ppm wt % oxygen. In the alloys which use titanium, tantalum, tungsten, zirconium or vanadium as the carbide former the alloy may contain an impurity of 0 to 0.3 wt % molybdenum The new alloys have an acceptable galling resistance as carbides will still be formed, and the matrix continues to have a duplex autenitic/ferritic microstructure which undergoes secondary hardening due to the formation of an iron silicon intermetallic phase.

Further hardening is achievable by hot isostatic pressing (HIPPING) of the stainless steel alloy when in powder form where secondary hardening occurs within the ferritic phase of the duplex microstructure.

Although carbides continue to be formed the alloy has a resultant lover overall carbide caused, in part, by the weight percentage content of molybdenum and carbon giving an alloy with an acceptable hardness but greater ductility and toughness. This improvement in ductility opens up the range of range of applications where consideration to shock events has to be considered as well as the overall wear resistance requirement.

The invention claimed is:

1. An alloy consisting essentially of 19 to 22 wt % chromium, 8.5 to 10.5 wt % nickel, 5.25 to 6.0 wt % silicon, 0.25 to 2.0 wt % carbon, 4.0 to 10.5 wt % of a carbide former selected from the group consisting of molybdenum, tantalum, tungsten, zirconium, and vanadium, 0.3 to 0.5 wt % titanium, 0.1 to 0.5 wt % nitrogen, and the balance being iron plus impurities.

2. The alloy according to claim 1, wherein the impurities consist of 0 to 0.2 wt % cobalt, 0 to 0.3 wt % molybdenum, 0 to 0.03 wt % phosphor, and 0 to 0.03 wt % sulphur, and 0 to 0.1 wt % nitrogen.

3. The alloy according to claim 1, wherein the carbide former is tantalum, and tantalum is 4.0 to 9.0 wt %.

4. The alloy according to claim 3, wherein the impurities consist of 0 to 0.2 wt % cobalt, 0 to 0.5 wt % manganese, 0 to 0.3 wt % molybdenum, 0 to 0.03 wt % phosphor, 0 to 0.03 wt % sulphur, and 0 to 0.1 wt % nitrogen.

5. The alloy according to claim 1, wherein the carbide former is tantalum, nickel is 8.5 to 9.5 wt %, silicon is 5.25 to 5.75 wt %, carbon is 0.8 to 1.2 wt %, and tantalum is 4.0 to 6.0 wt %.

6. The alloy according to claim 1, wherein the carbide former is tungsten, and tungsten is 4.0 to 9.0 wt %.

7. The alloy according to claim 6, wherein nickel is 8.5 to 9.5 wt %, silicon is 5.25 to 5.75 wt %, carbon is 0.8 to 1.2 wt %, and tungsten is 4.0 to 6.0 wt %.

8. The alloy according to claim 6, wherein the impurities consist of 0 to 0.2 wt % cobalt, 0 to 0.5 wt % manganese, 0 to 0.3 wt % molybdenum, 0 to 0.03 wt % phosphor, 0 to 0.03 wt % sulphur, and 0 to 0.1 wt % nitrogen.

9. The alloy according to claim 1, wherein the carbide former is zirconium, and zirconium is 4.0 to 9.0 wt %.

10. The alloy according to claim 9, wherein nickel is 8.5 to 9.5 wt %, silicon is 5.25 to 5.75 wt %, carbon is 0.8 to 1.2 wt %, and zirconium is 4.0 to 6.0 wt %.

11. The alloy according to claim 9, wherein the impurities consist of 0 to 0.2 wt % cobalt, 0 to 0.5 wt % manganese, 0 to 0.3 wt % molybdenum, 0 to 0.03 wt % phosphor, 0 to 0.03 wt % sulphur, and 0 to 0.1 wt % nitrogen.

12. The alloy according to claim 1, wherein the carbide former is vanadium, and vanadium is 4.0 to 9.0 wt %.

13. The alloy according to claim 12, wherein nickel is 8.5 to 9.5 wt %, silicon is 5.25 to 5.75 wt %, carbon is 0.8 to 1.2 wt %, and vanadium is 4.0 to 6.0 wt %.

14. The alloy according to claim 12, wherein the impurities consist of 0 to 0.2 wt % cobalt, 0 to 0.5 wt % manganese, 0 to 0.3 wt % molybdenum, 0 to 0.03 wt % phosphor, 0 to 0.03 wt % sulphur, and 0 to 0.1 wt % nitrogen.

15. An article comprising an alloy as claimed in claim 1.

16. The alloy according to claim 1, wherein the alloy excludes niobium.

17. An alloy consisting essentially of 19 to 22 wt % chromium, 8.5 to 10.5 wt % nickel, 5.25 to 5.75 wt % silicon, 0.25 to 2.0 wt % carbon, 4.0 to 10.5 wt % molybdenum, 0.3 to 0.5 wt % titanium, 0.1 to 0.5 wt % nitrogen, and the balance being iron plus impurities.

18. The alloy according to claim 17, wherein carbon is 0.8 to 1.2 wt %, and molybdenum is 4.0 to 6.0 wt %.

19. The alloy according to claim 17, wherein carbon is 1.7 to 2.0 wt %, and molybdenum is 8.5 to 10.5 wt %.

20. The alloy according to claim 17, wherein the alloy excludes niobium.

* * * * *